US005722487A

United States Patent [19]

McFadden

[11] Patent Number: 5,722,487

[45] Date of Patent: Mar. 3, 1998

[54] HEAT TRANSFER CHANNEL ON THE OUTSIDE OF A TANK

[76] Inventor: John P. McFadden, 735 Berkshire Ct., Dwoner Grove, Ill. 60516

[21] Appl. No.: 633,292

[22] Filed: Apr. 16, 1996

[51] Int. Cl.[6] ..... F28D 1/06

[52] U.S. Cl. ..... 165/169; 126/378

[58] Field of Search ..... 165/169, 76; 126/378

[56] References Cited

U.S. PATENT DOCUMENTS

| | | | |
|---|---|---|---|
| 3,318,376 | 5/1967 | Vihl | 165/169 |
| 3,595,307 | 7/1971 | Mowatt-Larsson et al. | 165/169 X |
| 3,685,458 | 8/1972 | Price et al. | 165/169 X |
| 4,205,720 | 6/1980 | Epstein | 165/169 |

FOREIGN PATENT DOCUMENTS

| | | | |
|---|---|---|---|
| 1095865 | 12/1960 | Germany | 165/169 |

*Primary Examiner*—Leonard R. Leo

[57] ABSTRACT

A heat transfer channel with an improved channel member is disclosed for circulating a heat transfer fluid over the end surface of a large tank. The channel member has an arcuate cross-section and comprises a number of substantially straight sections arranged in a spiral pattern welded to the outer surface of the end of the tank. The straight sections are separated by fillets which also have arcuate cross-sections but are shaped like a fan, the ends of the fillets diverging from each other at about 60°. The ends of the fillets match the arcuate cross-sectional ends of the straight sections and are welded to them at joints which are approximately normal to the longitudinal axes of the straight sections.

9 Claims, 1 Drawing Sheet

HEAT TRANSFER CHANNEL ON THE OUTSIDE OF A TANK

This invention relates to channelling members constructed upon the outside surfaces of the ends of large tanks for carrying heat transfer fluids over those surfaces and controlling the temperature of the tank contents. More particularly, it relates to a channel member having substantially straight sections arranged in a spiral pattern and joined together by arcuately shaped fillets which create an obtuse angle between successive straight sections. The fillets are joined to the straight sections at points substantially spaced apart from the angle.

BACKGROUND OF THE INVENTION

Welding a spiral shaped heat transfer conduit to the end of a vessel is shown in the patent to Epstein, U.S. Pat. No. 4,205,720, which issued Jun. 3, 1980. The conduit described in that patent is made of metal, preferably an expensive variety, and has a uniform cross-section with an arcuate periphery of between 130° and 150° of a circle, although earlier conduits having 180° arcuate peripheral cross-sections are referred to. Epstein's method of making the spiral shaped coil is to form semi-circular conduit sections which are fastened end to end by welding, each succeeding conduit section having a larger diameter than its predecessor conduit section. The spiral shaped coil thus formed has an inlet end and an outlet end, one at the center of the coil and one at the end of the last, largest diameter section. A variety of different heat transfer fluids may be used. When the fluid is a gas, the inlet is at the outer end of the spiral, and when the fluid is a liquid the inlet is at the inner end of the spiral.

Subsequent changes to the Epstein spiral have been made using straight sections of 130°–150° tori laid in a hexagonal pattern. In that arrangement, the ends of the straight sections come together at mitered joints. Such forms have benefitted from the cost savings achieved by eliminating the tolerance requirements for specific diameters of half-coiled sections, and the varied inventory of different half-coiled sections needed for a full spiral. However, an obvious disadvantage they have is the difficulty of forming good welds at the joints. Bearing in mind that heat transfer conduits carry hot oil in the 400°–500° F. range, or steam heated to the 400° F. range, and sometimes hot water elevated close to 212° F., it is imperative that the joints in a conduit are leakproof to begin with and have operational tolerances which permit them to last.

Some previous conduit constructions have also used alternating straight sections running substantially parallel to each other, joined at their ends by U-shaped sections. Such constructions have had limited acceptance because of their interference with the flow of fluid through them and because of the costs associated with constructing the U-shaped end connectors.

Efficient coverage of tank ends, most of which are circular, requires a balancing of many variables, including the total area which can be covered by a heat transfer conduit, the amount of turbulence of the fluid which can be achieved within the conduit, the rate of fluid flow from inlet to outlet, the cost of forming the conduit material and the cost of labor for assembling a conduit on the tank end.

SUMMARY OF THE INVENTION

The present invention combines broad area coverage over the end of a tank, unhindered fluid flow, and a regular rate of flow with low cost fabrication of parts and ease of installation. Longitudinally elongate segments and fillets are alternately arranged in a spiral pattern on the outer surface of the end face of a tank, and each of the elongate segments intermediate the ends of the spiral pattern has its end portions registered with and joined to an adjacent fillet. The elongate segments and the fillets have substantially arcuately shaped cross sections with edge portions secured to the outer surface of the tank end and zenith portions spaced apart from the outer surface of the tank, thereby forming an enclosed tubular passageway with the surface of the tank. The passageway turns at an obtuse angle at each fillet. The junctions of each of the fillets with their adjoining elongate segments are substantially spaced apart from the turning of the tubular passageway between successive elongate segments.

It is an object of this invention to provide a heat transfer channelling member having a plurality of substantially straight sections disposed at successive obtuse angles to one another and a joint section between each of them which minimizes the stresses at the joints of carrying a heat transfer fluid between successive straight sections and maintains the integrity of the channelling member throughout its length.

It is another object of this invention to provide a channelling member for carrying a heat transfer fluid against the end of a tank which includes a joint section element intermediate each pair of obtusely disposed substantially straight toroidal sections.

It is another object of this invention to provide a channelling member for carrying a heat transfer fluid which includes a plurality of straight sections arranged in a hexagonal spiral pattern over the end of the tank and arcuate toroidal fillets intermediate the straight sections having cross-sectional end faces diverging from each other at about 60°.

Other objects and advantages of this invention will be apparent from an examination of the accompanying drawings and the following detailed description.

DETAILED DESCRIPTION OF THE PREFERRED EMBODIMENT

Figure 1:
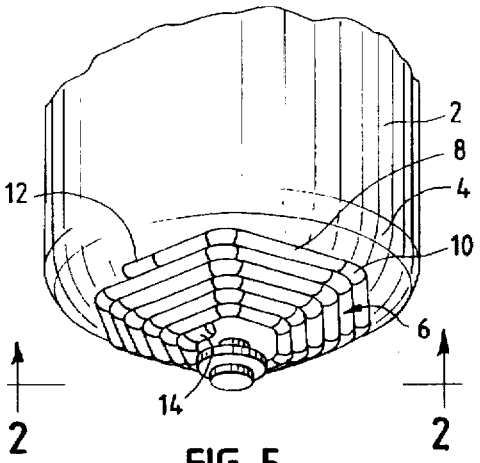
FIG. 1 is a perspective view, partially broken away, of an embodiment of the invention, illustrating a channelling member incorporating the present invention arranged on the outer surface of the bottom end of a tank.
Figure 2:
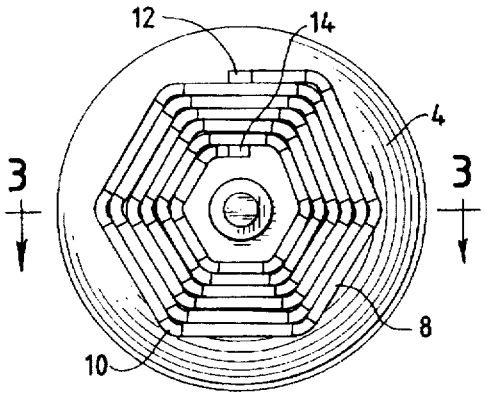
FIG. 2 is a plan view of the tank end and channelling member shown in FIG. 1, taken in the direction of line 2—2 in FIG. 1.

In FIG. 1, the lower portion of the tank 2 which is shown includes a lower, closed end having an outer face 4 on which the improved channelling member 6 of this invention is arranged in a spiral pattern. As shown in FIG. 2, the spiral takes the form of a hexagon, utilizing a plurality of elongated, substantially straight segments 8, with fillets 10 alternately disposed between them. The area which is covered on the outside surface of the tank by the channelling member of this invention may vary from vessel to vessel, but the diameter of one tank end on which it has been used was about thirteen feet. The distance across the hexagonal spiral was about eight feet.

At the outer end of the spiral, as shown in FIG. 2, there is a first port section 12, which may be either an inlet or an outlet port, depending upon whether the heat transfer fluid being used is a gas or a liquid. A second port section 14 is located at the inner end of the spiral to complement the first port section as an input or outlet section.

Figure 5:
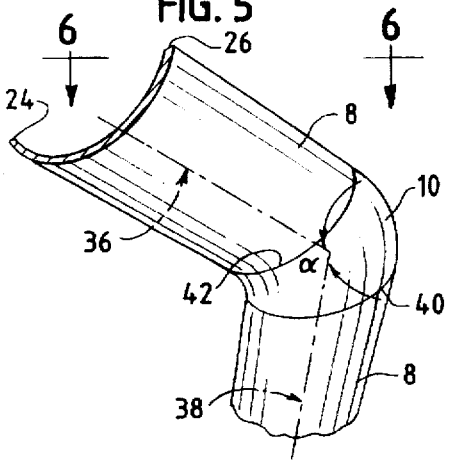
FIG. 5 is an enlarged perspective view, partly broken away, of three connected sections of the channelling member shown in FIG. 1, taken in the direction of the right arrow 2 in FIG. 1.
Figure 3:
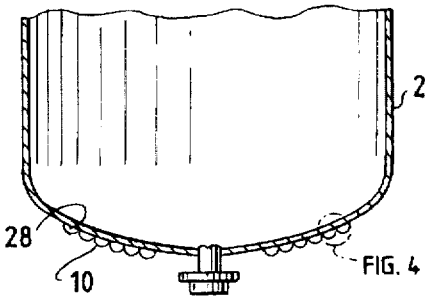
FIG. 3 is a sectional view of the tank end and channelling member shown in FIG. 2, taken along the line 3—3 in FIG. 2.
Figure 4:
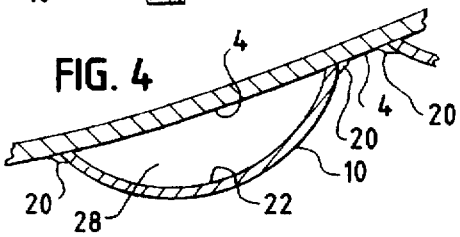
FIG. 4 is an enlarged sectional view, partly broken away, of a portion of the tank end and channelling member in the dotted circle marked "FIG. 4" in FIG. 3.
Figure 6:
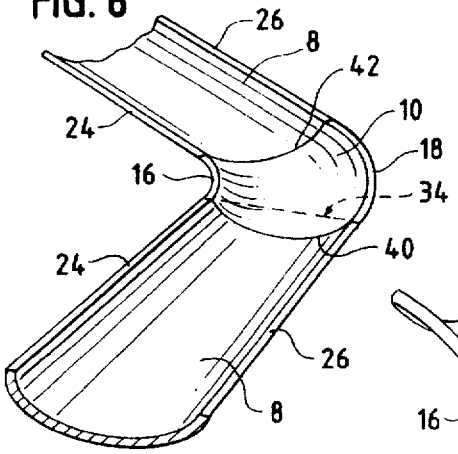
FIG. 6 is an enlarged, perspective view of the portion of the channelling member shown in FIG. 5, taken in the direction of arrow 6 in FIG. 5.

Both the elongate segments 8 and the fillets 10 are formed with convex cross sections, as shown for example with respect to a fillet 10 in FIG. 4. The inner edge portion 16, which is located closer to the center of the spiral, and the outer edge portion 18, located farther away from the center of the spiral than edge 16, are secured to the outer surface 4 of the tank end by welds 20, and the zenith portion 22 of the fillet is spaced apart from outer surface 4 of the tank end. Similarly, the inner edge portions 24 of the elongate members 8 in FIGS. 5 and 6 are also arranged to be welded to the tank end's outer surface 4. The outer edge portions 26 of elongate members 8 are welded to the outer surface 4 of the tank as well. When the inner and outer edges of the fillets and elongate members are affixed to the outer surface of the tank's end, an enclosed tubular passageway 28 (see FIG. 4) is formed with the surface of the tank through which a heat transfer fluid may be circulated.

The elongate segments 8 and the fillets 10 are preferably made of stainless steel. One gauge which has been found to be useful is No. 12, a thickness which can be readily rolled into an arch-shaped member. For an elongate segment 8, which has been shaped in this manner so that it has a cross-sectional arch from its inner edge to its outer edge, the distance from the extreme inner edge to the extreme outer edge is about three and three-fourths inches, and when an elongate segment 8 is welded to the outer surface of a tank, the maximum distance from outer surface 4 of the tank to the arched inner surface of elongate segment is about 11/16 inch. However, elongate elements having approximately this configuration may be made in nominal widths of two, six and eight inches, in addition to the nominal width of four inches just described, and utilized in the present invention. Likewise, the curvature of the arch in elongate sections which may be used in the present invention may be varied up to 180°, which is the curvature in a coil utilizing a half-pipe radius.

Figure 7:
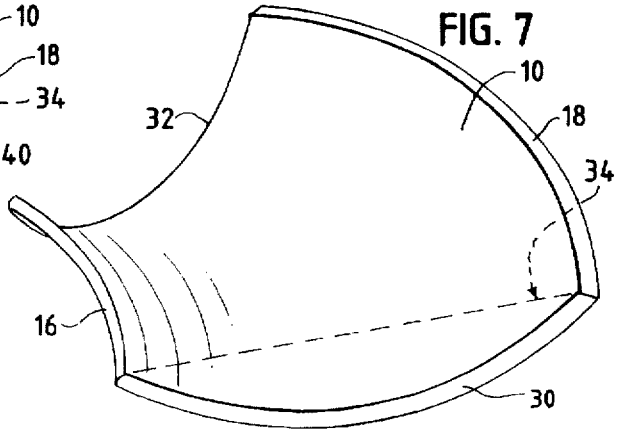
FIG. 7 is an enlarged, perspective view of a fillet element in the portion of the channelling member shown in FIGS. 5 and 6.

Successive elongate segments 8 are connected by fillets 10 and disposed at an obtuse angle to each other in the hexagonal spiral of channelling member 6. The fillets 10 are preferably formed by spinning. The inner and outer edges 16 and 18 are formed using radii of concentric circles and then slicing the spinning along the longer radii so that the ends 30 and 32 of a fillet 10, as shown in FIGS. 5 through 7, diverge outwardly from each other at approximately 60°.

In the form shown in the drawings, the shorter radius used for determining the arc of the inner edge 16 of a fillet 10 is two inches long, while the longer radius, used for determining the arc of the outer edge 18, is five and three-quarters inches long. Using such radii generates a fillet 10 with a chord 34 three and three-fourths inches long from the inner edge 16 to the outer edge 18, exactly the same length as a cord extending from inner edge 24 to outer edge 26 in an elongate segment 8 (see FIG. 6). Fillet end 30 is formed to register exactly with the cross-sectionally directed end face of an elongate segment 8, and fillet end 32 is similarly formed. When fillet ends 30 and 32 are joined, as by welding, to the ends of successive elongate segments 8 which they are adjacent to, the resulting tubular passageway 28 is made to turn at an obtuse angle between the successive elongate segments 8.

Such an obtuse angle is identified at α in FIG. 5, utilizing the dotted lines 36 and 38, laid along the zeniths of successive elongate segments 8 and extended until they intersect beyond the elongate segments, as the sides of the angle. The junction 40 of the fillet end 30 with the end of an elongate segment 8, and the junction 42 of fillet end 32 with the end of a successive elongate segment 8, are located a substantial distance away from the vertex of the obtuse angle α.

Preferably, the elongate segments form good butt joints with the ends of fillets 10. The inner and outer longitudinal edges 24 and 26 of an elongate segment 8, respectively, are parallel to and the same length as a zenith of that elongate segment 8, as shown in part at dotted line 36 and junction 42. The edges 24 and 26 expand and contrast equidistantly along the length of the elongate segment under changes in temperature of a fluid in passageway 28. When the junction 42 is exactly normal to zenith 36, little or no shearing force will occur at the junction 42 during expansion and contraction, and the length of a weld at the butt joint is the shortest, both of which assist in preserving the integrity of the walls of passageway 28. As the angular relation between the junction 42, for example, and the zenith 36 departs from normal, the shear force at the junction during expansion and contraction increases, and the junction's integrity becomes more suspect during use.

By spacing the junctions 40 and 42 a substantial distance from the vertex of obtuse angle α, and by forming an arched, gradually-turning surface of passageway 28 inside the fillets 10, the pressure inside passageway 28 on the seams of the passageway adjacent the end of the elongate sections is substantially further reduced, and leaks are avoided. Also, the turbulence of the heat transfer fluid, set up by the plurality of successive elongate sections being disposed obtusely to each other throughout the spiral, is not blocked by sharp turns and is passed smoothly from one segment to the next on its journey to the outlet port.

Those skilled in the art will readily see that while numerous detailed variations of the above-described embodiment of this invention may be made, the true scope of the invention is to be determined by the following claims

What is claimed is:

1. A channelling member for passing a heat transferring fluid along an outer surface of an end face of a tank comprising:

longitudinally elongate segments and fillets alternately arranged in a spiral pattern upon the outer surface of the end face of the tank, each elongate segment intermediate ends of the spiral pattern having end portions registered with and joined to an adjacent fillet, the elongate segments and fillets having substantially arcuately shaped cross sections with edge portions secured to the outer surface of the tank end face and zenith portions spaced apart from the outer surface of the tank face end forming an enclosed tubular passageway with the outer surface of the tank, and the passageway being turned at each fillet at an obtuse angle between successive elongate segments.

2. The channelling member of claim 1 in which each of the fillets includes an arcuately shaped inner edge and an arcuately shaped outer edge longer than the inner edge.

3. The channelling member of claim 1 in which each of the fillets is fan-shaped and includes an inner edge secured to the tank end face and an opposite outer edge secured to the tank end face, the inner edge being substantially shorter than the outer edge.

4. The channelling member of claim 2 in which the inner and outer edges of the fillet lie in arcs of concentric circles.

5. The channelling member of claim 1 in which the zenith of each elongate segment forms a straight line.

6. The channelling member of claim 5 in which each junction of the fillet to an adjoining elongate segment is normal to an axis of the elongate segment disposed along the zenith of the segment.

7. The channeling member of claim 5 in which each elongate segment has inner and outer longitudinal edge portions which are parallel to and equal length to the segment zenith.

8. The channelling member of claim 7 in which the inner and outer longitudinal edges of each elongate segment are substantially of equal length and expand and contract equidistantly along the length of the elongate segment under changes in temperature of fluid in the passageway.

9. The channelling member of claim 1 in which a first junction of the fillet to an adjoining elongate segment is spaced apart from a second junction of the fillet to a succeeding elongate segment.

* * * * *